US012281805B2

(12) United States Patent
Park et al.

(10) Patent No.: US 12,281,805 B2
(45) Date of Patent: Apr. 22, 2025

(54) OUTDOOR UNIT OF AIR CONDITIONER

(71) Applicant: LG ELECTRONICS INC., Seoul (KR)

(72) Inventors: Kiyoon Park, Seoul (KR); Hyunwook Bae, Seoul (KR); Jonghae Lee, Seoul (KR); Gwansoo Lee, Seoul (KR); Taegyu Kim, Seoul (KR); Hyoungjune Kim, Seoul (KR); Siyoung Choi, Seoul (KR); Junhee Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 2 days.

(21) Appl. No.: 18/399,983

(22) Filed: Dec. 29, 2023

(65) Prior Publication Data

US 2025/0027663 A1 Jan. 23, 2025

(30) Foreign Application Priority Data

Jul. 18, 2023 (KR) ..... 10-2023-0093034

(51) Int. Cl.
*F24F 1/24* (2011.01)

(52) U.S. Cl.
CPC ..... *F24F 1/24* (2013.01)

(58) Field of Classification Search
CPC ..... F24F 1/24; F24F 1/22; F24F 1/46; F24F 11/36; F24F 1/48; F24F 1/56; H05K 7/20136
USPC ..... 62/498
See application file for complete search history.

(56) References Cited

U.S. PATENT DOCUMENTS

2012/0194041 A1* 8/2012 Hika ..... F24F 1/46 312/100
2021/0071882 A1* 3/2021 Devrath ..... F24F 1/50
2022/0018580 A1 1/2022 Kim et al.
(Continued)

FOREIGN PATENT DOCUMENTS

DE 20-2018-006480 9/2020
KR 10-2003-0073360 9/2003
KR 10-2022-0010865 1/2022
(Continued)

OTHER PUBLICATIONS

European Search Report dated Jun. 24, 2024 issued in Application No. 24151436.3.
(Continued)

*Primary Examiner* — Steve S Tanenbaum
(74) *Attorney, Agent, or Firm* — KED & ASSOCIATES

(57) ABSTRACT

An outdoor unit of an air conditioner may include a case that forms an outside air inlet; a barrier that partitions an inside of the case into a heat exchange space and an electric space; a heat exchanger disposed in the heat exchange space; a fan disposed in the heat exchange space; a compressor disposed in the electric space; and a control box assembly disposed in the electric space. The control box assembly may include a control box connected to the outside air inlet and having electric components disposed therein; and a heat dissipation duct connected to an inside of the control box and that extends from one side of the control box to the barrier. The air introduced through the outside air inlet may be discharged to the heat exchange space after passing through the control box and the heat dissipation duct.

20 Claims, 10 Drawing Sheets

(56) References Cited

U.S. PATENT DOCUMENTS

| | | | |
|---|---|---|---|
| 2024/0050512 | A1 | 2/2024 | Masood et al. |
| 2024/0125489 | A1 | 4/2024 | Yaji et al. |

FOREIGN PATENT DOCUMENTS

| | | |
|---|---|---|
| WO | WO 2022/190268 | 9/2022 |
| WO | WO 2023/112430 | 6/2023 |

OTHER PUBLICATIONS

Korean Office Action issued in Application No. 10-2023-0093034 dated Dec. 16, 2024.

* cited by examiner

OUTDOOR UNIT OF AIR CONDITIONER

CROSS-REFERENCE TO RELATED APPLICATION(S)

The present application claims priority under 35 U.S.C. 119 and 35 U.S.C. 365 to Korean Patent Application No. 10-2023-0093034, filed in Korea on Jul. 18, 2023, which is hereby incorporated by reference in its entirety.

BACKGROUND

1. Field

An outdoor unit of an air conditioner is disclosed herein.

2. Background

An air conditioner is a device that cools and heats an indoor space by heat exchange between a refrigerant flowing in a heat exchange cycle and indoor air and outdoor air. The air conditioner includes a compressor that compresses the refrigerant, an outdoor heat exchanger that exchanges heat between the refrigerant and outdoor air, and an indoor heat exchanger that exchanges heat between the refrigerant and indoor air.

The air conditioner may include a heat storage tank. A fluid heated or cooled by a refrigerant circulating in the air conditioner may be stored in the heat storage tank. For example, the fluid may include water.

The outdoor unit of the air conditioner may include a case, the compressor accommodated inside of the case, the outdoor heat exchanger, and the heat storage tank.

As global environmental regulations gradually increase, conversion to eco-friendly refrigerants is required. For example, some countries are enacting related laws to use only refrigerants with a Global Warming Potential (GWP) of 100 or less within the next five years, and among refrigerants that satisfy this requirement, R290 is emerging as a highly competitive refrigerant in terms of eco-friendliness and performance. However, the refrigerant R290 has a problem in that it is highly explosive and requires a higher level of safety design than other existing refrigerants.

BRIEF DESCRIPTION OF THE DRAWINGS

Embodiments will be described in detail with reference to the following drawings in which like reference numerals refer to like elements, and wherein.

DETAILED DESCRIPTION

Figure 1:
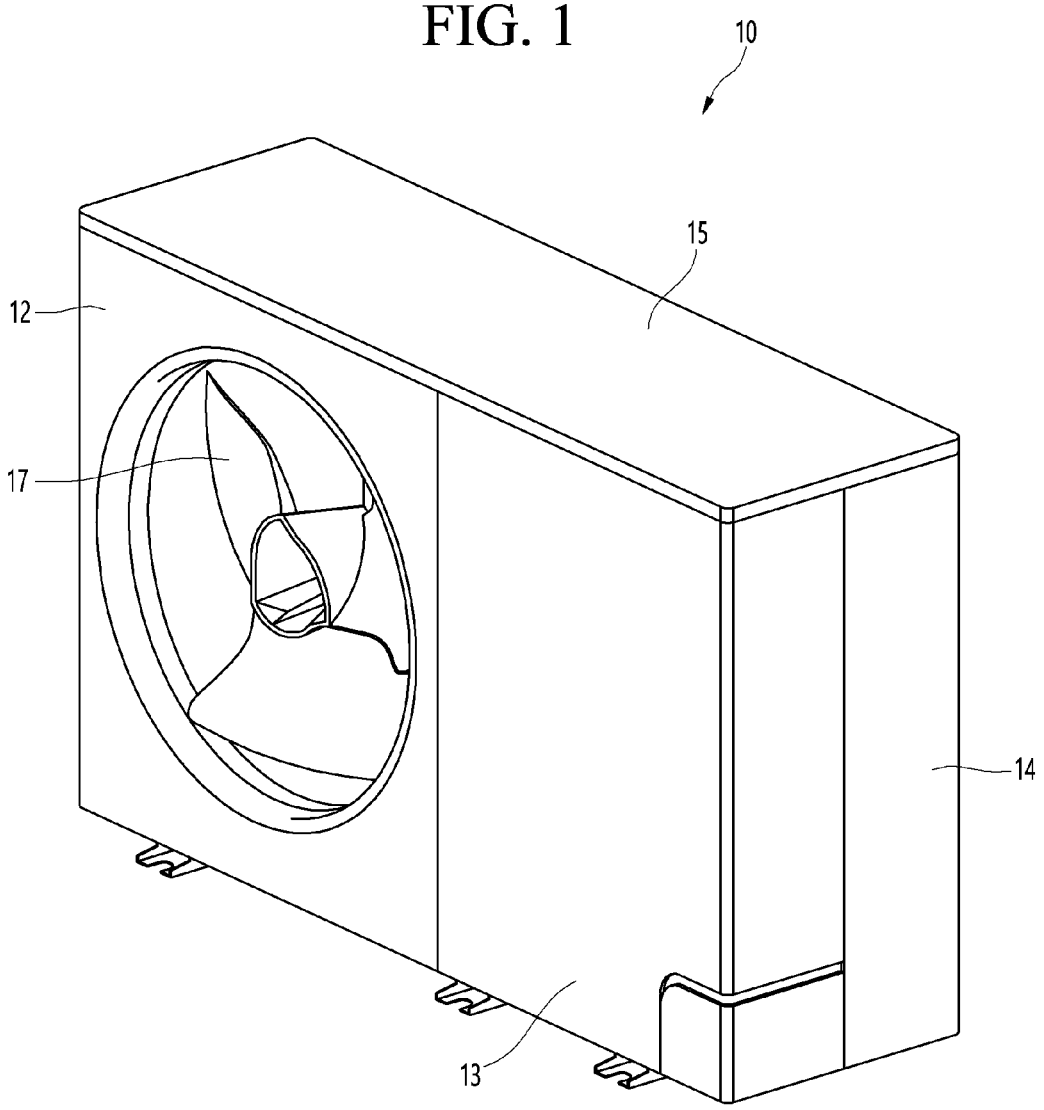
FIG. 1 is a front perspective view of an outdoor unit of an air conditioner according to an embodiment.

Reference will now be made to embodiments disclosed herein, examples of which are illustrated in the accompanying drawings. Wherever possible, the same or like reference numerals have been used to indicate the same or like components, and repetitive disclosure has been omitted.

In the following description of embodiments, reference is made to the accompanying drawings that form a part hereof, and in which is shown by way of illustration specific embodiments in which may be practiced. These embodiments are described in sufficient detail to enable those skilled in the art to practice the embodiments, and it is understood that other embodiments may be utilized and that logical structural, mechanical, electrical, and chemical changes may be made without departing from the scope. To avoid detail not necessary to enable those skilled in the art to practice the embodiments, description may omit certain information known to those skilled in the art. The following description is, therefore, not to be taken in a limiting sense.

Also, in the description of embodiments, terms such as first, second, A, B, (a), (b) or the like may be used herein when describing components. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 2:
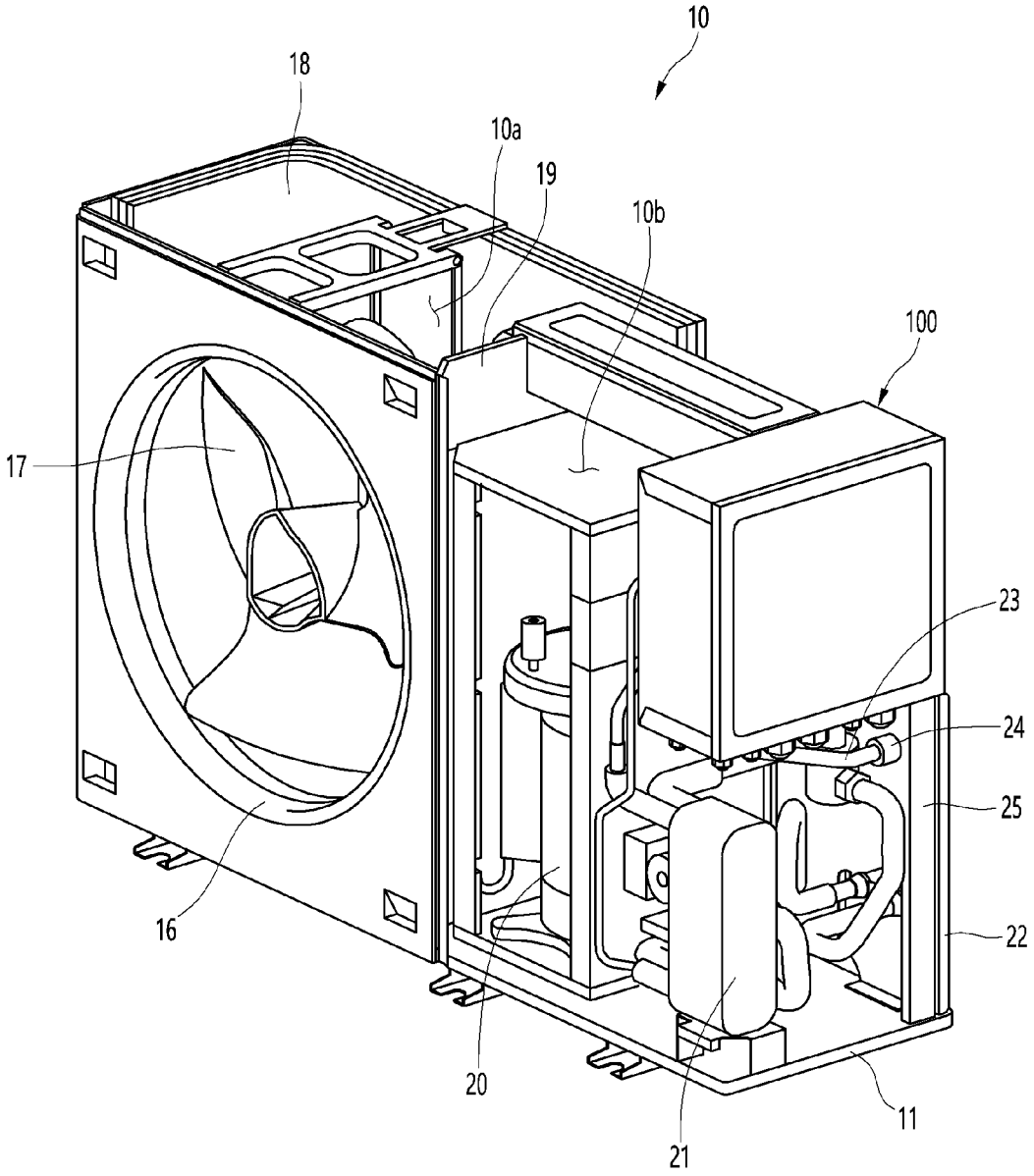
FIG. 2 is a front perspective view of the outdoor unit in a state in which the case is removed.

FIG. 1 is a front perspective view illustrating an outdoor unit of an air conditioner according to an embodiment disclosed herein. FIG. 2 is a front perspective view of the outdoor unit in a state in which the case is removed therefrom.

Referring to FIGS. 1 and 2, the outdoor unit 10 of the air conditioner according to an embodiment may include a case forming an outer appearance of the outdoor unit. The case may include a base panel 11 forming a bottom surface of the outdoor unit 10, a first front panel 12 disposed on one or a first side of a front end portion of the base panel 11, and a second front panel 13 disposed on the other or a second side of the front end portion of the base panel 11. The case may further include a side panel 14 disposed on a side of the base panel 11 and a top panel 15 forming an upper surface of the outdoor unit 10.

The outdoor unit 10 may further include an orifice 16 coupled to the first front panel 12, a fan 17 located behind the orifice 16, and a heat exchanger 18 disposed on an upper surface of the base panel 11. The outdoor unit 10 may further include a barrier 19 disposed on the upper surface of the base panel 11. The barrier 19 may partition an upper space of the base panel 11 into a heat exchange space 10*a* and an electric space 10*b*.

A heat exchanger 18 may be disposed in the heat exchange space 10*a*. The heat exchanger 18 may be bent and extend along a side end portion and a rear end portion of the base panel 11 to define a side surface and a rear surface of the heat exchange space 10*a*.

One or a first side end portion of the first front panel 12 may be coupled to a front end portion of the heat exchanger 18 and the other or a second side end portion may be coupled to a front end portion of the barrier 19. A rear end portion of the barrier 19 may be connected to a side end portion of the heat exchanger 18.

The outdoor unit 10 may further include a compressor 20 and a heat storage tank 21 disposed on the upper surface of the base panel 11 corresponding to the electric space 10*b*. The heat storage tank 21 may be disposed spaced apart from the compressor 20. A flow path may be provided inside of the heat storage tank 21 to enable heat exchange between refrigerant and a fluid, such as water, without mixing. A refrigerant passage and a fluid passage may be arranged to exchange heat inside of the heat storage tank 21, so that heat may be transferred from the refrigerant flowing along the refrigerant flow path to the fluid flowing along the fluid flow path.

The refrigerant passing through the compressor 20 may flow into the heat storage tank 21 along a refrigerant pipe. A fluid pipe unit connected to the fluid flow path may be connected to the heat storage tank 21.

The refrigerant passing through the heat storage tank 21 may be guided to the heat exchanger 18 along the refrigerant pipe. The refrigerant passing through the heat exchanger 18 may be guided to a heat exchanger of an indoor unit after passing through an expansion valve. The refrigerant passing through the indoor unit may be returned to the compressor 20 after passing through a gas-liquid separator.

When the fan 17 rotates, outdoor air may flow into the outdoor unit 10 through a short side portion of the heat exchanger 18 forming a side surface of the outdoor unit 10 and a long side portion of the heat exchanger 18 forming a rear surface of the outdoor unit 10. The air that has passed through the heat exchanger 18 may flow from a rear surface toward a front surface of the fan 17, pass through the orifice 16, and then be discharged to an outside of the outdoor unit 10.

A portion of a plurality of blades constituting the fan 17 may be accommodated inside of the orifice 16 so that all of the air forcedly flowing due to the fan 17 may pass through the orifice 16.

The outdoor unit 10 may further include a control box assembly 100 accommodated in the electric space 10*b*. The control box assembly 100 may be disposed above the compressor 20. The control box assembly 100 may be disposed above the heat storage tank 21. The control box assembly 100 will be described hereinafter with reference to the drawings.

The case may further include a back cover that defines a rear surface of the electric space 10*b*. The case may further include a support panel 22 disposed in front of the back cover.

An outside air inlet through which outdoor air of the outdoor unit 10 may be introduced may be formed in the back cover. The outside air inlet may be formed in the back cover corresponding to a lower side of the control box assembly 100.

The support panel 22 may be coupled with a connector 24 of an air pipe 23 that guides air introduced through the outside air inlet to the control box assembly 100. The air pipe 23 may connect the connector 24 and the control box assembly 100 so that an outside and an inside of the control box assembly 100 may communicate.

The air pipe 23 may be formed of a flexible material. The air pipe 23 may connect the outside air inlet and the air inlet of the control box assembly 100.

When the fan 17 rotates, an internal pressure of the outdoor unit 10 becomes lower than an external pressure. Then, outdoor air is introduced into the outdoor unit 10 through the outdoor air inlet. Outdoor air suctioned through the outside air inlet may be discharged to the heat exchange space 10*a* after flowing inside of the control box assembly 100 along the air pipe 23.

In this process, components provided inside of the control box assembly 100 may be quickly cooled by an air cooling method. The air discharged into the heat exchange space 10*a* may be combined with air forcedly flowing due to the fan 17 and then may be discharged to the outside of the outdoor unit 10.

The outdoor unit 10 may further include a support bracket 25 that supports the control box assembly 100. The support bracket 25 may be disposed on the upper surface of the base panel 11 and may support a lower side of the control box assembly 100. A plurality of the support bracket 25 may be provided to support a lower surface of the control box assembly 100, respectively.

One or a first side of the control box assembly 100 may be coupled to the back cover, and the other or a second side of the control box assembly 100 may be coupled to the barrier 19.

Figure 3:
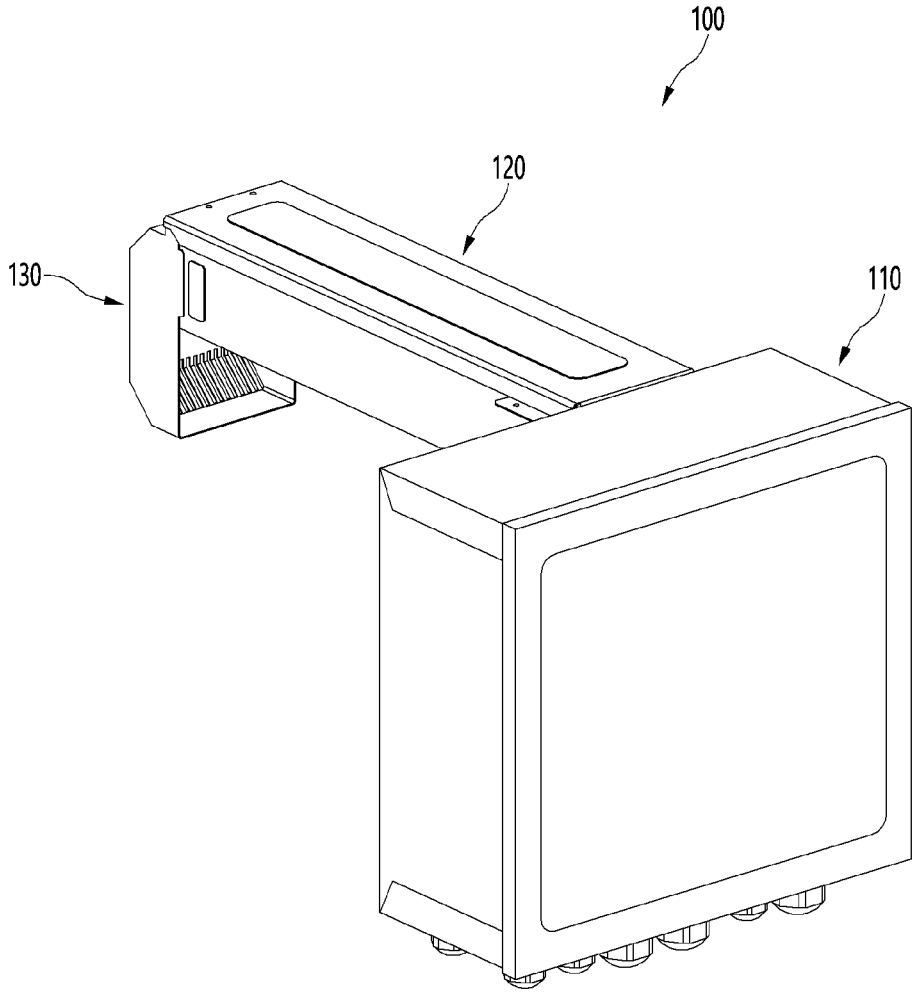
FIG. 3 is a front perspective view of a control box assembly according to an embodiment.
Figure 4:
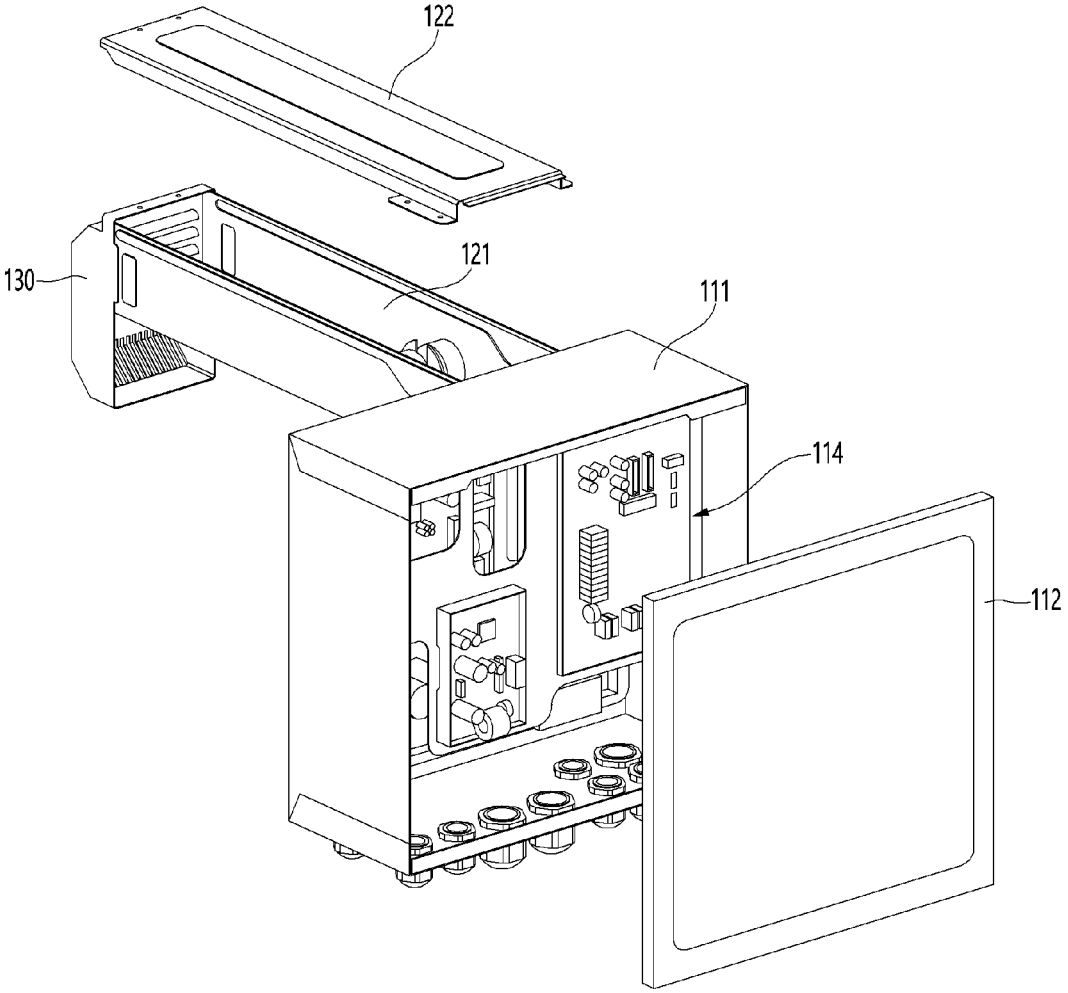
FIG. 4 is a front perspective view of the control box assembly in a state in which a box cover and a duct cover are separated therefrom.
Figure 5:
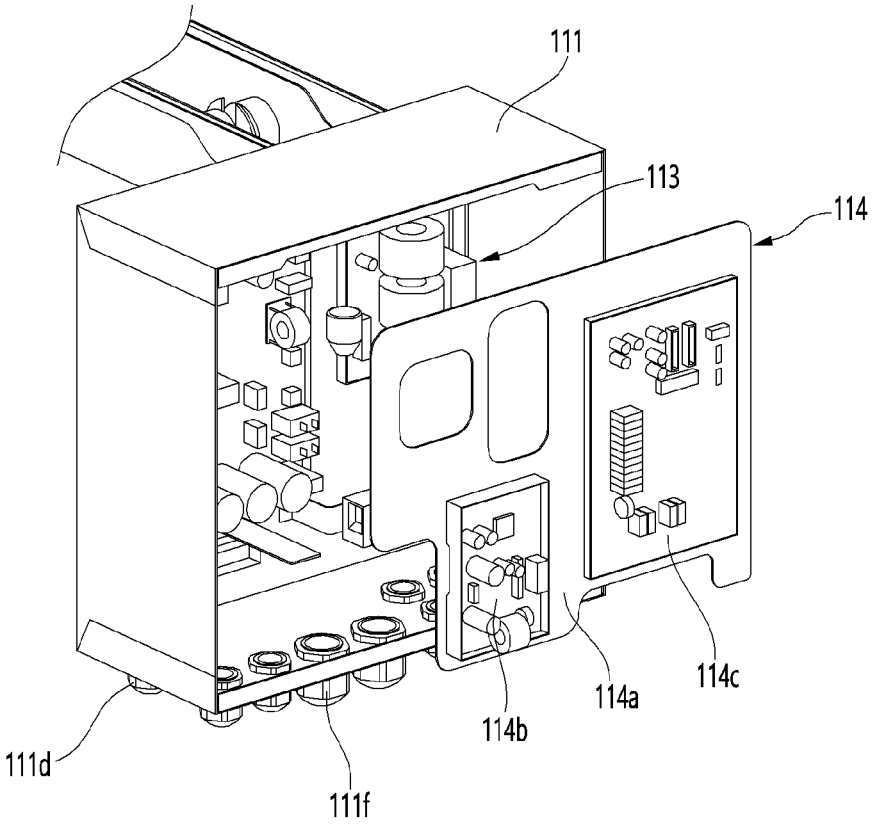
FIG. 5 is a front perspective view of the control box in a state in which a printed circuit board (PCB) module is separated therefrom.
Figure 6:
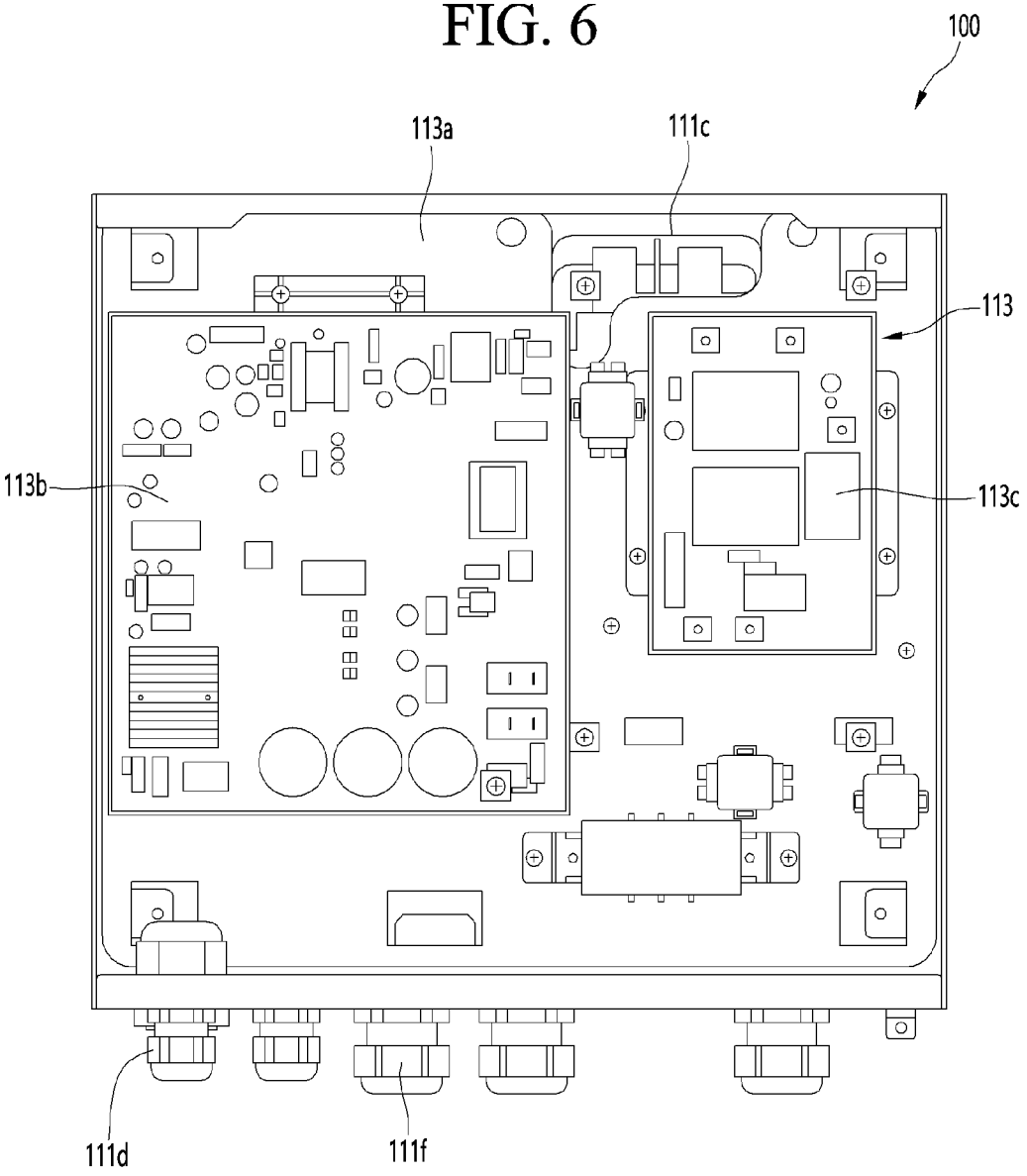
FIG. 6 is a front view of the control box in a state in which the PCB module is separated.
Figure 7:
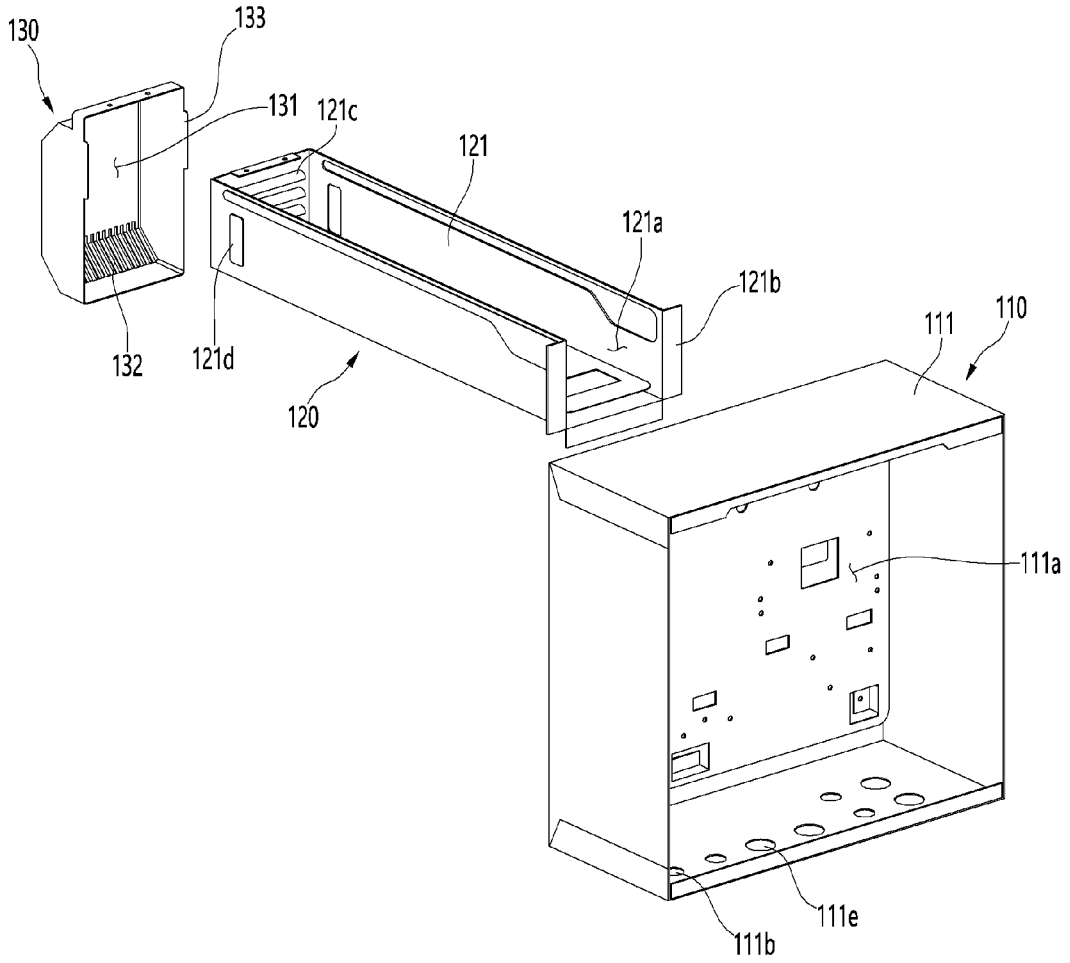
FIG. 7 is an exploded perspective view illustrating a state in which a control box, a heat dissipation duct, and a heat dissipation cover are separated therefrom.
Figure 8:
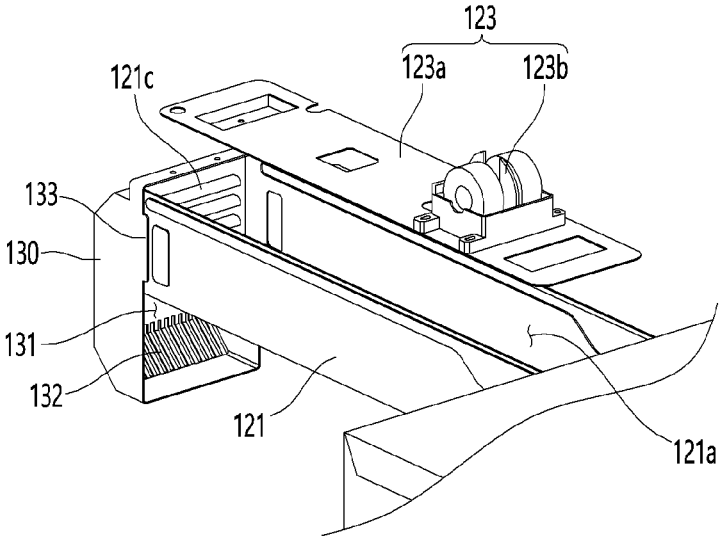
FIG. 8 is a front perspective view of a heat dissipation duct in a state in which a reactor bracket is separated.

FIG. 3 is a front perspective view of a control box assembly according to an embodiment. FIG. 4 is a front perspective view of the control box assembly in a state in which a box cover and a duct cover are separated therefrom. FIG. 5 is a front perspective view of the control box in a state in which a PCB module is separated therefrom, and FIG. 6 is a front view of the control box in a state in which the PCB module is separated therefrom. FIG. 7 is an exploded perspective view illustrating a state in which a control box, a heat dissipation duct, and a heat dissipation cover are separated, and FIG. 8 is a front perspective view of a heat dissipation duct in a state in which a reactor bracket is separated therefrom.

Referring to FIGS. 3 to 8, the control box assembly 100 according to an embodiment may include a control box 110. The control box assembly 100 may further include a heat dissipation duct 120, and a heat dissipation cover 130.

The control box 110, the heat dissipation duct 120, and the heat dissipation cover 130 may be coupled and fixed to each other. The heat dissipation duct 120 may be disposed between the control box 110 and the heat dissipation cover 130. The control box 110 may be coupled to a front of the heat dissipation duct 120 and the heat dissipation cover 130 may be coupled to a rear of the heat dissipation duct 120.

The control box 110 may be disposed above the heat storage tank 21. The heat dissipation duct 120 may be disposed above the compressor 20. The heat dissipation cover 130 may be disposed in the heat exchange space 10*a* above the fan 17.

The control box 110 may include a box case 111 that accommodates electric components and a box cover 112 coupled to one side of the box case 111. The box case 111 may have a hexahedral shape with an open front surface. An accommodation space 111*a* that accommodates electric components may be formed inside of the box case 111. However, embodiments are not limited thereto, and the box case 111 may be formed in the shape of a polyhedron, for example. The box case 111 may be formed of a metal material, for example.

The box case 111 may include a lower surface portion that forms a bottom surface of the box case 111, side surface portions forming both side surfaces, an upper surface portion forming an upper surface, and a rear surface portion forming a rear surface. The box case 111 may have an open front surface, and electric components may be installed through the open front surface.

The box case 111 may include a case inlet 111*b* through which air suctioned through the air pipe 23 may be introduced, and a case outlet 111*c* through which air inside of the box case 111 may be discharged to the outside. The case inlet 111*b* may be disposed at a higher point than the outside air inlet. The case inlet 111*b* may be disposed at a lower point than the case outlet 111*c*. Accordingly, the air suctioned through the outside air inlet may move upward from the inside of the box case 111.

The case inlet 111*b* may be formed on the lower surface portion of the box case 111. For example, the case inlet 111*b* may be formed at a left or first lateral edge of the lower surface portion of the box case 111.

A sealing connector 111*d* to which an end portion of the air pipe 23 is coupled may be provided in the case inlet 111*b*. The sealing connector 111*d* may include a rubber bush, a fastening nut, and a sealing nut, for example, which have a sealing function. After the end portion of the air pipe 23 is inserted into the sealing connector 111*d*, sealing between the air pipe 23 and the sealing connector 111*d* is possible by tightening the fastening nut and the sealing nut.

The case outlet 111*c* communicates with an inside of the heat dissipation duct 120. The case outlet 111*c* may be formed on a rear surface portion of the box case 111. For example, the case outlet 111*c* may be formed at a right or lateral edge of the rear surface portion of the box case 111. Accordingly, an air flow path for cooling components may be formed in an area adjacent to the rear surface portion of the box case 111.

In addition, as the case inlet 111*b* and the case outlet 111*c* are formed at one or a first edge and the other or a second edge of the box case 111, respectively, an air flow path for cooling components may be relatively long. Accordingly, there is an effect of improving heat dissipation performance of the component.

The box case 111 may further include an electric wire through-hole 111*e* through which an electric wire may pass. The electric wire through-hole 111*e* may be understood as a portion through which electric wires connected to a printed circuit board (PCB) provided inside of the box case 111 may be drawn out. The electric wire through-hole 111*e* may be formed on a lower surface portion of the box case 111.

A sealing connector 111*f* to which an end portion of an electric wire may be coupled may be provided in the electric wire through-hole 111*e*. As the sealing connector 111*f* has the same configuration as the previously described sealing connector 111*d*, repetitive description thereof has been omitted.

The box cover 112 may be coupled to shield the open front surface of the box case 111. When the box cover 112 is coupled to the box case 111, an inside of the box case 111 may be sealed.

The control box 110 may further include a first PCB module 113 installed inside of the box case 111. The first PCB module 113 may be understood as a portion in or to which a component with relatively high heat generation is mounted. The first PCB module 113 may be installed on the rear surface portion of the box case 111.

The first PCB module 113 may include a first PCB bracket 113*a*, an inverter PCB 113*b* installed on one or a first side of the first PCB bracket 113*a*, and a noise filter PCB 113*c* installed on the other or a second side of the first PCB bracket 113*a*.

The first PCB bracket 113*a* may be formed in a rectangular plate shape, for example. The first PCB bracket 113*a* may be disposed inside of the box case 111 so that a front surface of the first PCB bracket is exposed. The first PCB bracket 113*a* may be installed on the rear surface portion of the box case 111 so that an air flow path for cooling components passes therethrough.

Referring to FIG. 6, the inverter PCB 113*b* may be disposed on a front left or first lateral side of the first PCB bracket 113*a*, and the noise filter PCB 113*c* may be disposed on a front right or second lateral side of the first PCB bracket 113*a*. The inverter PCB 113*b* and the noise filter PCB 113*c* are components with relatively high heat generation and may be disposed at a point adjacent to the case outlet 111*c* of the box case 111. The inverter PCB 113*b* and the noise filter PCB 113*c* may be disposed on the rear surface portion of the box case 111 adjacent to the case outlet 111*c*. Therefore, while the air introduced through the case inlet 111*b* of the box case 111 flows to the case outlet 111*c*, the inverter PCB 113*b* and the noise filter PCB 113*c* may be intensively cooled.

The control box 110 may further include a second PCB module 114 installed inside of the box case 111. The second PCB module 114 may be understood as a portion in which a component with relatively low heat generation is mounted. The second PCB module 114 may be installed on the side surface portion or the upper surface portion of the box case 111.

The second PCB module 114 may include a second PCB bracket 114*a*, a sub-PCB 114*b* installed on one or a first side of the second PCB bracket 114*a*, and a main PCB 114*c* installed on the other or a second side of the second PCB bracket 114*a*. The second PCB bracket 114*a* may be formed in a rectangular plate shape, for example. The second PCB bracket 114*a* may be spaced apart from a front of the first PCB bracket 113*a*. The second PCB bracket 114*a* may have an area smaller than an area of the first PCB bracket 114*a*.

The second PCB bracket 114*a* may be disposed adjacent to the open front surface portion of the box case 111, that is, the box cover 112. The second PCB bracket 114*a* may be disposed inside of the box case 111 so that a front surface of the second PCB bracket is exposed.

The sub PCB 114*b* may be disposed on a left front or first lateral side of the second PCB bracket 114*a*. The main PCB 114*c* may be disposed on a right front or second lateral side of the second PCB bracket 114*a*.

The sub-PCB 114*b* and the main PCB 114*c* are components with relatively low heat generation and may be disposed at positions spaced apart from the case outlet 111*c* of the box case 111. The sub PCB 114*b* and the main PCB 114*c* may be disposed on a side of the box cover 112 spaced forward from the case outlet 111*c*.

In summary, the first PCB module 113, in which a component with relatively high heat generation is mounted, is disposed adjacent to a side of the rear surface portion of the box case 111 where an air flow path for cooling the component is formed, and thus, there is an effect that intensive cooling of the high heating component may be achieved. In addition, the second PCB module 114, in which a component with relatively low heat generation is mounted, is disposed adjacent to a side of the box cover 112 spaced apart from the air flow path for cooling the component, and thus, there is an effect of securing an installation space for installing components.

The heat dissipation duct 120 may be connected to the control box 110 and serve as a passage that guides the air discharged through the case outlet 111*c* of the control box 110 to the heat exchange space 10*a*. The heat dissipation duct 120 may have a front end portion connected to the rear surface portion of the control box 110 and a rear end portion connected to the barrier 19. That is, the heat dissipation duct 120 may extend from the rear surface portion of the control box 110 to the barrier 19.

The heat dissipation duct 120 may include a duct case 121 that accommodates electric components and a duct cover 122 coupled to one side of the duct case 121. The duct case 121 may have a hexahedral shape with open front and top surfaces, for example. An accommodation space 121*a* that accommodates electric components may be formed inside of the duct case 121. The duct case 121 may extend in a frontward and rearward direction, so that a front end portion may be coupled to the rear surface portion of the control box 110 and a rear end portion may be coupled to the barrier 19. However, embodiments are not limited thereto, and the duct case 121 may be formed in the shape of a polyhedron. The duct case 121 may be formed of a metal material, for example.

The duct case 121 may include a lower surface portion that forms a bottom surface thereof, a side surface portion that forms both side surfaces thereof, and a rear surface portion that forms a rear surface thereof. Front and upper surfaces of the duct case 121 may be open, and electric components may be installed through the open front and upper surfaces.

The duct case 121 may include a case coupling portion 121*b* configured to be coupled with the control box 110. The case coupling portion 121*b* may be understood as a portion for welding the duct case 121 to the box case 111. The case coupling portion 121*b* may be formed by bending the front end portion of the duct case 121 outward. The case coupling portion 121*b* may extend outward along a front edge of the duct case 121 and come into close contact with the rear surface portion of the box case 111.

When the duct case 121 is coupled to the rear surface portion of the box case 111, the open front surface of the duct case 121 and the case outlet 111*c* of the box case 111 may be connected. Accordingly, the air flowing inside of the box case 111 may flow into the duct case 121 through the case outlet 111*c*.

The duct case 121 may further include a duct outlet 121*c* through which internal air of the duct case 121 is discharged to the outside. The duct outlet 121*c* may be formed on a rear surface portion of the duct case 121. The duct outlet 121*c* may be formed in the form of a plurality of discharge grilles. The duct outlet 121*c* may be connected to the heat exchange space 10*a* of the outdoor unit 10 where the fan 17 is disposed. Accordingly, the air flowing inside of the duct case 121 may be quickly introduced into a suction side of the fan 17 through the duct outlet 121*c*.

The duct case 121 may further include a cover coupling portion 121*d* configured to be coupled with the heat dissipation cover 130. The cover coupling portion 121*d* may be understood as a portion where the duct case 121 and the heat dissipation cover 130 are fastened by, for example, a fastening member. The cover coupling portion 121*d* may be formed on both side surfaces of the duct case 121, respectively. The cover coupling portion 121*d* may be formed on both side surfaces adjacent to the rear end portion of the duct case 121, respectively, so that coupling with the heat dissipation cover 130 may be facilitated.

The duct cover 122 may be coupled to shield the open upper surface of the duct case 121. When the duct case 121 is coupled to the rear surface portion of the box case 111 and the duct cover 122 is coupled to the duct case 121, the inside of the duct case 121 may be sealed.

The heat dissipation duct 120 may further include a reactor module 123 installed inside of the duct case 121. The reactor module 123 may include a reactor bracket 123*a* and a reactor 123*b* installed in the reactor bracket 123*a*.

The reactor bracket 123*a* may be formed in a rectangular plate shape, for example. The reactor bracket 123*a* may extend lengthwise in the frontward and rearward direction corresponding to the shape of the duct case 121. The reactor bracket 123*a* may be formed of a metal material, for example.

The reactor bracket 123*a* may be seated and supported on a bottom surface of the duct case 121. The reactor bracket 123*a* may be, for example, welded and fixed to the bottom surface of the duct case 121.

The reactor 123*b* may be understood as an electronic device that stores electromagnetic energy and exhibits a large inductive reactance with respect to a rapid change in current. The reactor 123*b* may be installed on an upper surface of the reactor bracket 123*a*. The reactor 123 may be fastened to the reactor bracket 123*a* by, for example, a fastening member.

The reactor 123*b* is a component with relatively high heat generation. Therefore, by disposing the reactor 123*b* inside of the duct case 121, the reactor 123*b* may be cooled by an air cooling method.

In addition, a left-right or lateral width or air flow cross-sectional area of the duct case 121 may be smaller than a left-right or lateral width or air flow cross-sectional area of the box case 111. Accordingly, the flow cross-sectional area of the air flow path for cooling the component gradually decreases, so that a flow rate of air may be increased. If the flow rate of air increases, cooling of the reactor 123*b* may be performed more quickly.

The heat dissipation cover 130 may be connected to the heat dissipation duct 120 and guide the air discharged through the duct outlet 121*c* of the heat dissipation duct 110 to the heat exchange space 10*a*. In addition, the heat dissipation cover 130 covers the duct outlet 121*c* of the heat dissipation duct 120, and serves to prevent moisture and foreign substances from entering from the outside.

The heat dissipation cover 130 may be coupled to the rear surface portion of the heat dissipation duct 120. The heat dissipation cover 130 may be coupled to both side surfaces and the rear surface of the duct case 121 to cover the duct outlet 121*c* of the duct case 121.

The heat dissipation cover 130 may be formed in the shape of a polyhedron with an open front surface, for example. The heat dissipation cover 130 may extend lengthwise in a vertical direction and may cover the duct outlet 121*c* of the duct case 121.

The heat dissipation cover 130 may be disposed in the heat exchange space 10*a* of the outdoor unit 10. The heat dissipation cover 130 may be disposed above or on the side of the fan 17 disposed in the heat exchange space 10*a*. A flow space 131 through which air flows may be formed inside of the heat dissipation cover 130.

The heat dissipation cover 130 may include a lower surface portion that forms a bottom surface thereof, a side surface portion that forms both side surfaces thereof, an upper surface portion that forms an upper surface thereof, and a rear surface portion that forms a rear surface thereof. The heat dissipation cover 130 has an open front surface, and at least a portion of the open front surface may face the duct outlet 121*c* of the duct case 121. Accordingly, an inside of the heat dissipation cover 130 and the inside of the duct case 121 may be in communication with each other.

At least one of the upper surface portion, the rear surface portion, or the lower surface portion of the heat dissipation cover 130 may be formed stepwise to have a gradient shape. Therefore, there is an effect of preventing rainwater from penetrating from outside into the heat dissipation duct 120 or condensed water scattered by rotation of the fan 17 from penetrating into the heat dissipation duct 120.

The heat dissipation cover 130 may include a cover outlet 132 through which internal air of the heat dissipation cover 130 is discharged to the outside (a heat exchange space). The cover outlet 132 may be formed on at least one of the rear surface portion or the lower surface portion of the heat dissipation cover 130. However, to prevent water introduced from the outside through the cover outlet 132 from penetrating into the heat dissipation duct 120 through the duct outlet 121*c*, the cover outlet 132 may be located at a lower point than the duct outlet 121*c*. With this configuration, the air discharged through the duct outlet 121*c* may be bent downward inside of the heat dissipation cover 130 and then discharged to the heat exchange space 10*a* through the cover outlet 132. In addition, as the duct outlet 121*c* is covered by the heat dissipation cover 130 and the cover outlet 132 is disposed at a lower point than the duct outlet 121*c*, permeation of water through the cover outlet 132 may be prevented in advance.

The heat dissipation cover 130 may further include a duct coupling portion 133 coupled to the heat dissipation duct 120. The duct coupling portion 133 may be understood as a portion where the heat dissipation cover 130 and the heat dissipation duct 120 are fastened by, for example, a fastening member. The duct coupling portion 133 may be formed on both side surfaces of the heat dissipation cover 130, respectively. The duct coupling portion 133 is formed on both side surfaces adjacent to the front end portion of the heat dissipation cover 130, so that coupling with the heat dissipation duct 120 can be facilitated.

Figure 9:
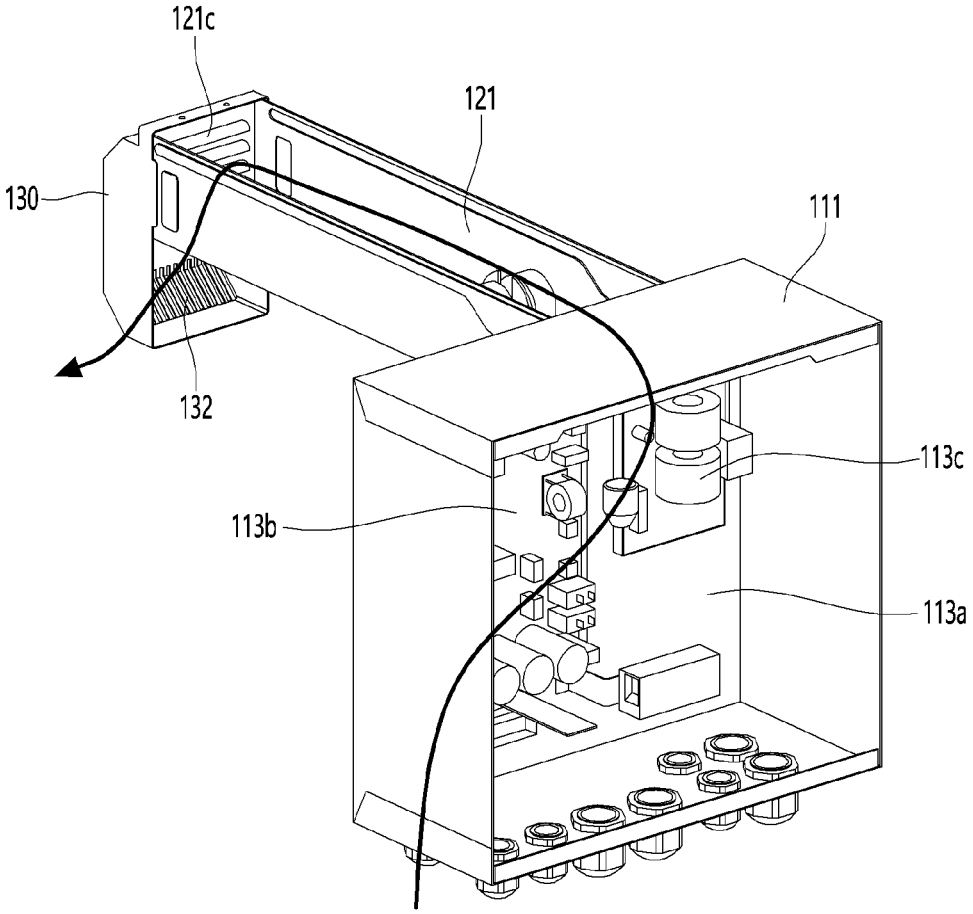
FIG. 9 is a perspective view illustrating a control box assembly for showing an air flow path for cooling components.
Figure 10:
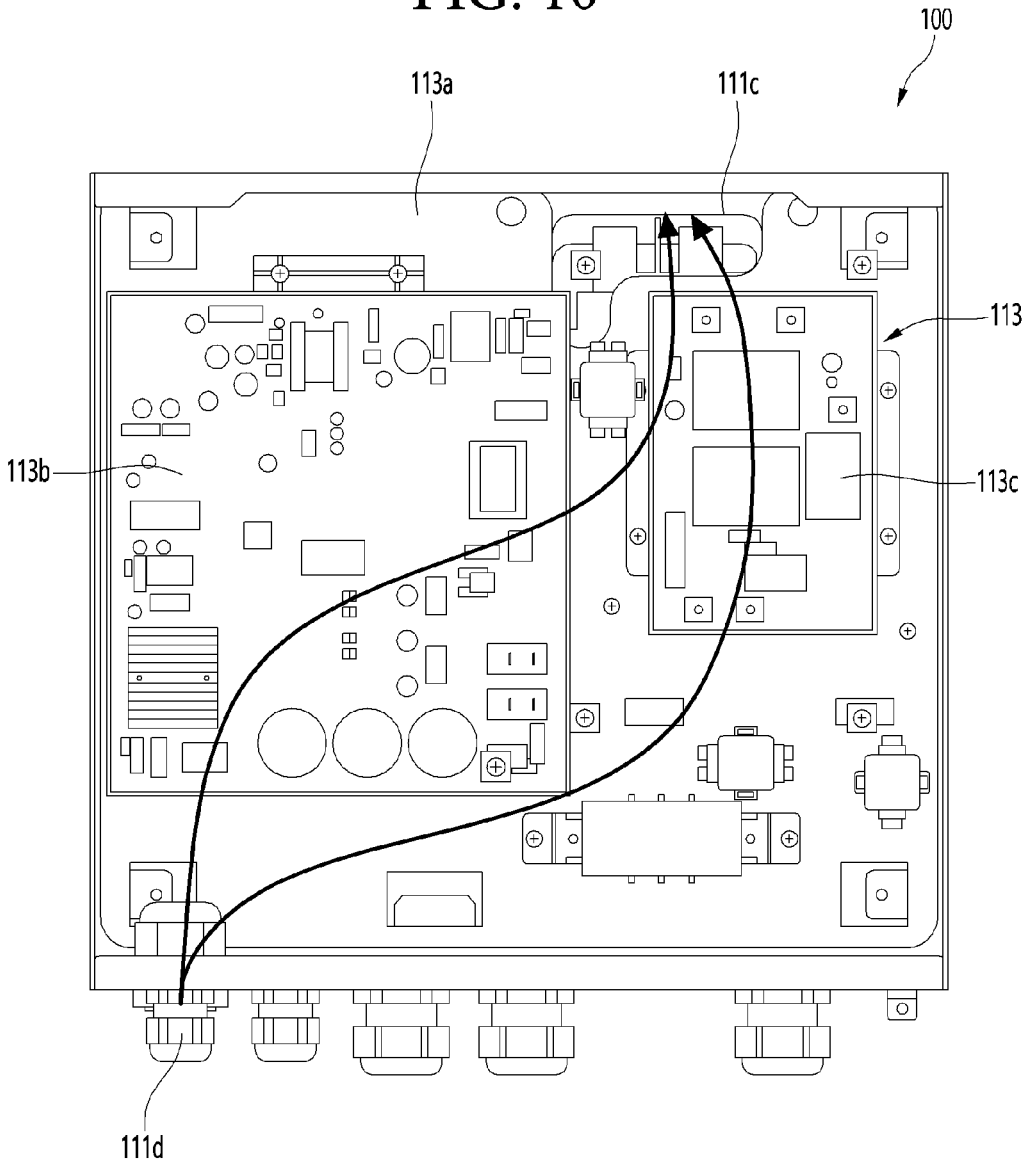
FIG. 10 is a front view illustrating a control box for showing an air flow path for cooling components.

FIG. 9 is a perspective view of a control box assembly for showing an air flow path for cooling components. FIG. 10 is a front view of a control box for showing an air flow path for cooling components.

Referring to FIGS. 2, 9, and 10 together, when the outdoor unit 10 according to an embodiment operates, the compressor 20 and the fan 17 operate. By driving the fan 17, an internal pressure of the outdoor unit 10 becomes lower than an external pressure. Then, outdoor air is introduced into the air pipe 23 through the outside air inlet. The air introduced into the air pipe 23 passes through the inside of the control box 110 through the case inlet 111*b* and then is discharged through the case outlet 111*c*.

In this process, components disposed inside of the control box 110 may be quickly cooled by an air cooling method. In particular, as the first PCB module 113 in which high heat components are disposed is disposed adjacent to the case inlet 111*b* and the case outlet 111*c*, heat dissipation performance of these components may be improved.

In addition, the case inlet 111*b* and the case outlet 111*c* are formed at one or a first corner portion and the other or a second corner portion facing diagonally from the one corner portion based on the rear surface portion of the box case 111, respectively. Thus, the cooling flow path may be formed as long as possible.

Air discharged through the case outlet 111*c* may be introduced into the heat dissipation duct 120 and then discharged to the outside through the duct outlet 121*c*. In this process, the reactor 123*b* disposed inside of the heat dissipation duct 120 may be cooled by an air cooling method.

In particular, as the lateral width or air flow cross-sectional area of the duct case 121 is smaller than the lateral width or the air flow cross-sectional area of the box case 111, the flow cross-sectional area of the air flow path is narrowed and the air flow rate may be increased. If the air flow rate increases, cooling of the reactor 123*b* may be performed more quickly.

Air discharged through the duct outlet 121*c* is introduced into the heat dissipation cover 130 and then discharged to the heat exchange space 10*a* through the cover outlet 132. The air discharged into the heat exchange space 10*a* is combined with air forcedly flowing due to the fan 17 and then discharged to the outside (front) of the outdoor unit 10.

According to the outdoor unit of the air conditioner according to embodiments disclosed herein having the above-described structure, at least the following advantages are obtained.

First, as the inside of the control box is made of a sealed structure, there is an effect of blocking access of refrigerant to the control box due to refrigerant leakage.

Second, as the air suctioned in through the outside air inlet passes through the inside of the control box and is discharged to the fan side, there is an effect of quickly cooling components by the air cooling method. In particular, as the case inlet and case outlet of the control box are spaced as far apart as possible, an air flow path for cooling components may be relatively long. Accordingly, heat dissipation performance of components may be improved. In addition, as the width or flow cross-sectional area of the heat dissipation duct is smaller than the width or flow cross-sectional area of the control box, a flow rate of air increases, so that cooling may be performed more quickly.

Third, inside of the control box, high-heat components are located adjacent to the case outlet and the low-heat components are located relatively apart from the case outlet, and thus, there is an effect that components may be efficiently cooled and space for installing components may be secured.

Fourth, as the heat dissipation cover is provided at the end portion of the heat dissipation duct, there is an effect of preventing external rainwater or condensate scattered by rotation of the fan from penetrating into the control box.

Fifth, as a cooling flow path may be formed by forcibly flowing air due to a pressure difference without installing a separate fan inside of the control box, there is an effect of reducing a unit cost of the component.

Embodiments disclosed herein provide an outdoor unit of an air conditioner capable of blocking access of refrigerant to a control box due to refrigerant leakage.

Embodiments disclosed herein further provide an outdoor unit of an air conditioner having a control box having internal airtightness.

Embodiments disclosed herein provide an outdoor unit of an air conditioner having a control box that is advantageous in dissipating heat from internal components.

Embodiments disclosed herein provide an outdoor unit of an air conditioner capable of cooling components by forcibly flowing air without installing a fan inside of a control box.

Embodiments disclosed herein provide an outdoor unit of an air conditioner capable of efficiently cooling components of the control box by optimizing an internal air flow path of the control box.

Embodiments disclosed herein provide an outdoor unit of an air conditioner capable of maximally securing an installation space in which electric components are installed while improving heat dissipation performance.

Embodiments disclosed herein provide an outdoor unit of an air conditioner capable of preventing external rainwater or condensate scattered by rotation of a fan from penetrating into a control box.

An outdoor unit of an air conditioner according to embodiments disclosed herein may include a case that forms an outside air inlet. The outdoor unit may further include a barrier that partitions an inside of the case into a heat exchange space and an electric space.

The outdoor unit may further include a heat exchanger disposed in the heat exchange space. The outdoor unit may further include a fan disposed in the heat exchange space.

The outdoor unit may further include a compressor disposed in the electric space. The outdoor unit may further include a control box assembly disposed in the electric space.

The control box assembly may include a control box connected to the outside air inlet and having electric components disposed therein. The control box assembly may further include a heat dissipation duct connected to an inside of the control box and extending from one side of the control box to the barrier. Air introduced through the outside air inlet may be discharged to the heat exchange space after passing through the control box and the heat dissipation duct.

The control box may include a case inlet through which air is introduced and a case outlet through which air is discharged. The outside air inlet and the case inlet may be connected by an air pipe.

The control box may include a box case having one surface open and forming an accommodation space in which the electrical components may be accommodated. The control box may further include a box cover coupled to the one open surface of the box case. The case inlet and the case outlet may be formed in the box case.

The box case may include a lower surface portion forming a bottom surface thereof. The box case may further include side surface portions forming both side surfaces thereof. The box case may further include an upper surface portion forming an upper surface thereof. The box case may further include a rear surface portion forming a rear surface thereof.

The front surface of the box case may be open. The rear surface portion of the box case may face the barrier. The case inlet may be formed on a lower surface portion of the box case. The case outlet may be formed on a rear surface portion of the box case.

The control box may further include a first PCB module installed on a rear surface portion of the box case. The control box may further include a second PCB module spaced apart from a front surface of the first PCB module.

The first PCB module may include a high heat generating component. The second PCB module may include a low heat generating component.

The heat dissipation duct may be coupled to the rear surface portion of the box case and may be connected to the case outlet. The heat dissipation duct may include a duct case having at least one open surface.

The heat dissipation duct may further include a duct cover coupled to the one open surface of the duct case. The duct case may include a duct outlet through which air introduced into the duct case is discharged to the outside.

The duct case may include a lower surface portion that forms a bottom surface thereof. The duct case may further include side surface portions that forms both side surfaces thereof. The duct case may further include a rear surface portion that forms a rear surface thereof. The front surface and the upper surface of the duct case may be open.

The duct outlet may be formed on the rear surface portion of the duct case.

An open front surface of the duct case may be covered by the rear surface portion of the box case. An open upper surface of the duct case may be covered by the duct cover.

The heat dissipation duct may further include a reactor module disposed inside of the duct case. A width or flow cross-sectional area of the duct case may be smaller than a width or flow cross-sectional area of the box case.

The outdoor unit may further include a heat dissipation cover connected to one side of the heat dissipation duct and that guides air passing through the heat dissipation duct to the heat exchange space. The heat dissipation cover may include a cover outlet through which air introduced into the heat dissipation cover is discharged to the heat exchange space. The cover outlet may be disposed at a point lower than the duct outlet.

The heat dissipation cover may include a lower surface portion that forms a bottom surface thereof. The heat dissipation cover may further include side surface portions that forms both side surfaces thereof.

The heat dissipation cover may further include an upper surface portion that forms an upper surface thereof. The heat dissipation cover may further include a rear surface portion that forms a rear surface thereof.

A front surface of the heat dissipation cover may be open. A side surface portion of the heat dissipation cover may be coupled to a side surface portion of the heat dissipation duct adjacent to a rear surface portion of the heat dissipation duct.

The cover outlet may be formed on at least one of a rear surface portion or a lower surface portion of the heat dissipation cover.

An outdoor unit of an air conditioner according to an embodiment may include a case that forms an outside air inlet. The outdoor unit may further include a barrier that partitions an inside of the case into a heat exchange space and an electric space.

The outdoor unit may further include a heat exchanger disposed in the heat exchange space. The outdoor unit may further include a fan disposed in the heat exchange space.

The outdoor unit may further include a compressor disposed in the electric space. The outdoor unit may further include a control box assembly disposed in the electric space corresponding to an upper side of the compressor.

The control box assembly may include a control box connected to the outside air inlet through an air pipe and having electric components disposed therein. The control box assembly may further include a heat dissipation duct connected to an inside of the control box and extending from one side of the control box to the barrier. The control box assembly may further include a heat dissipation cover connected to an end portion of the heat dissipation duct and that guides air inside of the heat dissipation duct to the heat exchange space.

The case may include a base panel that forms a bottom surface of the outdoor unit. The case may further include a front panel disposed on a front end portion of the base panel. The case may further include a side panel disposed on a side surface of the base panel. The case may further include a back cover disposed on a rear end of the base panel and defining a rear surface of the electrical equipment space.

The outside air inlet may be formed in the back cover. The control box may include a case inlet through which air is introduced. The control box may further include a case outlet through which air is discharged.

The outside air inlet and the case inlet may be connected by the air pipe. The case inlet may be disposed above the outside air inlet. The case inlet may be disposed below the case outlet.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An outdoor unit of an air conditioner, comprising:
- a case that forms an outside air inlet;
- a barrier that partitions an inside of the case into a heat exchange space and an electric space;
- a heat exchanger disposed in the heat exchange space;
- a fan disposed in the heat exchange space;
- a compressor disposed in the electric space; and
- a control box assembly disposed in the electric space, wherein the control box assembly includes:
  - a control box connected to the outside air inlet and having electric components disposed therein; and
  - a heat dissipation duct connected to an inside of the control box and that extends from one side of the control box to the barrier, and wherein the air introduced through the outside air inlet is discharged to the heat exchange space after passing through the control box and the heat dissipation duct.

2. The outdoor unit of claim 1, further comprising:
- a heat dissipation cover connected to one side of the heat dissipation duct and that guides the air passing through the heat dissipation duct to the heat exchange space.

3. The outdoor unit of claim 2, wherein the heat dissipation cover includes a cover outlet through which air introduced into the heat dissipation cover is discharged to the heat exchange space, and wherein the cover outlet is disposed lower than the duct outlet.

4. The outdoor unit of claim 3, wherein the heat dissipation cover includes:
- a lower surface portion that forms a bottom surface thereof;
- side surface portions that forms both side surfaces thereof;
- an upper surface portion that forms an upper surface thereof; and
- a rear surface portion that forms a rear surface thereof, wherein the front surface of the heat dissipation cover is open, and wherein one of the side surface portions of the heat dissipation cover is coupled to a side surface portion of the heat dissipation duct adjacent to a rear surface portion of the heat dissipation duct.

5. The outdoor unit of claim 4, wherein the cover outlet is formed on at least one of the rear surface portion or the lower surface portion of the heat dissipation cover.

6. The outdoor unit of claim 1, wherein the control box includes:

a case inlet through which air is introduced; and a case outlet through which air is discharged, and wherein the outside air inlet and the case inlet are connected by an air pipe.

7. The outdoor unit of claim 6, wherein the control box includes:

a box case having an open surface and forming an accommodation space in which the electrical components are accommodated; and a box cover coupled to the open surface of the box case, and wherein the case inlet and the case outlet are formed in the box case.

8. The outdoor unit of claim 7, wherein the box case includes:

a lower surface portion that forms a bottom surface thereof;

side surface portions that forms both side surfaces thereof;

an upper surface portion that forms an upper surface thereof; and a rear surface portion that forms a rear surface thereof, wherein a front surface portion of the box case is the open surface, and wherein the rear surface portion of the box case faces the barrier.

9. The outdoor unit of claim 8, wherein the case inlet is formed on the lower surface portion of the box case, and wherein the case outlet is formed on the rear surface portion of the box case.

10. The outdoor unit of claim 8, wherein the control box further includes:

a first printed board circuit (PCB) module installed on the rear surface portion of the box case; and a second PCB module spaced apart from a front of the first PCB module, wherein the first PCB module includes at least one high heat generating component, and wherein the second PCB module includes at least one low heat generating component.

11. The outdoor unit of claim 8, wherein the heat dissipation duct is coupled to the rear surface portion of the box case and is connected to the case outlet.

12. The outdoor unit of claim 11, wherein the heat dissipation duct includes:

a duct case at least one surface of which is open; and a duct cover coupled to the open surface of the duct case, and wherein the duct case includes a duct outlet through which air introduced into the duct case is discharged to the outside.

13. The outdoor unit of claim 12, wherein the heat dissipation duct further includes a reactor module disposed inside of the duct case.

14. The outdoor unit of claim 12, wherein a width or a flow cross-sectional area of the duct case is smaller than a width or a flow cross-sectional area of the box case.

15. The outdoor unit of claim 12, wherein the duct case includes:

a lower surface portion that forms a bottom surface thereof;

side surface portions that forms both side surfaces thereof; and a rear surface portion that forms a rear surface thereof, wherein a front surface and an upper surface of the duct case are open, and wherein the duct outlet is formed on the rear surface portion of the duct case.

16. The outdoor unit of claim 15, wherein the open front surface of the duct case is covered by the rear surface portion of the box case, and wherein the open upper surface of the duct case is covered by the duct cover.

17. An outdoor unit of an air conditioner, comprising:

a case that forms an outside air inlet;

a barrier that partitions an inside of the case into a heat exchange space and an electric space;

a heat exchanger disposed in the heat exchange space;

a fan disposed in the heat exchange space;

a compressor disposed in the electric space; and a control box assembly disposed in the electric space above the compressor, wherein the control box assembly includes:

a control box connected to the outside air inlet through an air pipe and having electric components disposed therein;

a heat dissipation duct connected to an inside of the control box and that extends from one side of the control box to the barrier; and a heat dissipation cover connected to an end portion of the heat dissipation duct and that guides air inside of the heat dissipation duct to the heat exchange space.

18. The outdoor unit of claim 17, wherein the case includes:

a base panel that forms a bottom surface thereof;

a front panel disposed on a front end portion of the base panel;

a side panel disposed on a side of the base panel; and a back cover disposed on a rear end of the base panel and that defines a rear surface of the electric space, and wherein the outside air inlet is formed in the back cover.

19. The outdoor unit of claim 18, wherein the control box includes:

a case inlet through which air is introduced; and a case outlet through which air is discharged, and wherein the outside air inlet and the case inlet are connected by the air pipe.

20. The outdoor unit of claim 19, wherein the case inlet is disposed above the outside air inlet and below the case outlet.

* * * * *